US005706882A

United States Patent [19]

Fellus et al.

[11] Patent Number: 5,706,882

[45] Date of Patent: Jan. 13, 1998

[54] CONTROL PROCESS FOR TWIN-ROLL CONTINUOUS CASTING

[75] Inventors: Gilles Fellus, Marines; Yves Leclercq, Etang-La Ville; Francois Mazodier, Saint-Etienne; Luc Vendeville, Bethune; Yann Breviere, Isbergues; Olivier Salvado, Thorigny, all of France

[73] Assignees: Usinor-Sacilor, Puteaux, France; Thyssen Stahl Aktiengesellschaft, Duisburg, Germany

[21] Appl. No.: 581,129

[22] Filed: Dec. 29, 1995

[30] Foreign Application Priority Data

Dec. 29, 1994 [FR] France ..... 9415981

[51] Int. Cl.[6] ..... B22D 11/16; B22D 11/06

[52] U.S. Cl. ..... 164/452; 164/154.5; 164/154.8; 164/480; 164/154.3; 164/154.1

[58] Field of Search ..... 164/452, 154.1, 164/154.5, 154.8, 480, 428, 454, 413, 154.3

[56] References Cited

U.S. PATENT DOCUMENTS

| | | | |
|---|---|---|---|
| 5,052,467 | 10/1991 | Tanaka et al. | 164/452 |
| 5,348,074 | 9/1994 | Strenbel | 164/454 |

FOREIGN PATENT DOCUMENTS

| | | | |
|---|---|---|---|
| 0095352 | 11/1983 | European Pat. Off. . | |
| 0138059 | 4/1985 | European Pat. Off. . | |
| 0194628 | 9/1986 | European Pat. Off. . | |
| 898135 | 11/1953 | Germany . | |
| 63-177944 | 7/1988 | Japan | 164/154.1 |

*Primary Examiner*—Joseph J. Hail, III
*Assistant Examiner*—I.-H. Lin
*Attorney, Agent, or Firm*—Nilles & Nilles SC

[57] ABSTRACT

Control process for twin-roll continuous casting, in which, during casting, the roll separation force (RSF) is measured and the position of the bearings of at least one of the rolls is varied in order to increase or decrease the center-to-center spacing of the rolls, with a view to keeping the force substantially constant, a band (ΔRSF) of force values bracketing a desired nominal force ($RSF_0$) is predetermined and the position of the bearings is varied more sharply when the value of the measured force lies outside the band than when it lies within the band. Application especially to the twin-roll continuous casting of thin steel strip.

12 Claims, 5 Drawing Sheets

FIG. 1
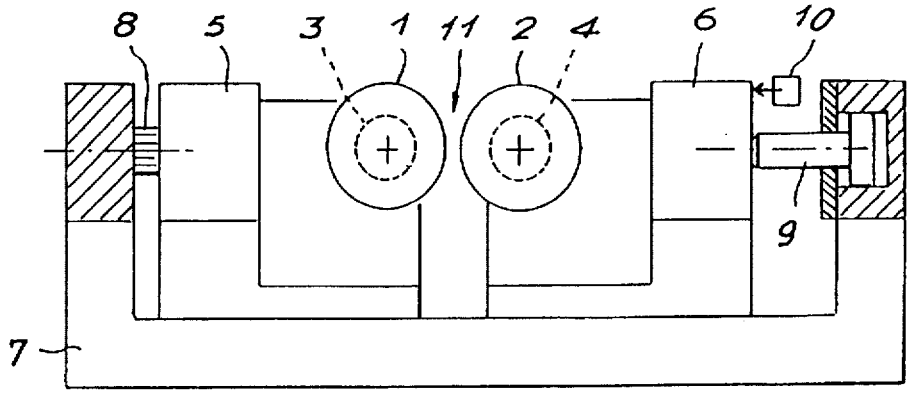
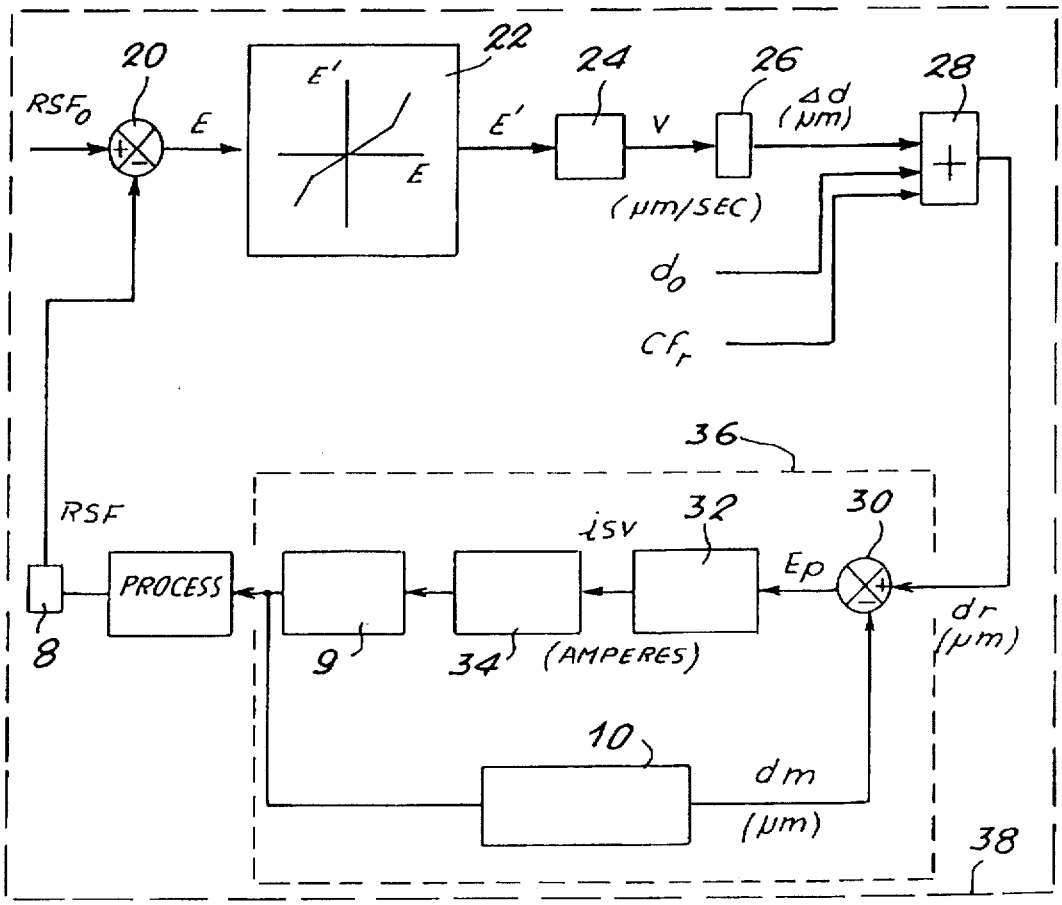
FIG. 2

CONTROL PROCESS FOR TWIN-ROLL CONTINUOUS CASTING

BACKGROUND OF THE INVENTION

The present invention relates to twin-roll continuous casting of thin metal products, especially steel products.

According to this known technique, the product manufactured, for example a thin steel strip a few millimeters in thickness, is obtained by pouring the molten metal into a casting space defined between two rolls having parallel axes, these rolls being cooled and driven in counter rotation. On contacting the cold walls of the rolls, the metal solidifies and the solidified skins of metal, entrained by the rotation of the rolls, join up in the region of the neck between the rolls in order to form the strip, which is extracted downwards.

The implementation of the twin-roll casting process is subject to various constraints, regarding both the cast product and the set-up of the casting plant.

The cast strip must, in particular, have a cross-section corresponding, in terms of shape and size, to the desired cross-section.

This means that the gap in the neck between the rolls, that is to say the distance between the two rolls, should be substantially equal to the desired thickness of the strip. In fact, since the strip obtained is conventionally subjected afterwards to a rolling operation, the precision in the thickness is less important than its uniformity over the entire length of the strip. Thus, a deviation of a few tenths of a millimeter in the thickness with respect to the desired thickness is not prejudicial to obtaining a quality finished product, after rolling, whereas rapid variations in thickness along the longitudinal direction of the cast strip could have repercussions on the finished product, despite the said rolling.

From the standpoint of implementing the casting process, the main constraint is, of course, to obtain a continuous strip, and it is therefore necessary to extract the strip and for this strip to be sufficiently solidified while it is being extracted. Oversolidification of the metal upstream of the neck is not necessarily prejudicial in the case of casting relatively malleable metals, for example aluminium, but it is unacceptable for harder metals, such as steel, since then such an oversolidification leads either to the formation of a wedge of metal above the neck, preventing extraction, or to damage of the rolls as the excessively solidified metal passes between them.

Conversely, insufficient solidification leads to breakouts and to rupture of the strip downstream of the neck.

In order to avoid these two causes of malfunction, it is known to vary the separation of the rolls, by moving them closer together in the case of insufficient solidification or moving them further apart in the case of oversolidification, so that the bottom of the solidification well, between the solidified skins of metal in contact with the walls of the rolls, is kept level with the neck.

This inevitably results in longitudinal variations in thickness of the product obtained when the solidification conditions vary during casting, for various reasons, especially during startup, during the first revolutions of the rolls and while they are coming up to a steady temperature. However, these variations are unacceptable from the standpoint of the quality of the cast strip.

Yet more problems are added to the ones mentioned hereinabove, especially those related to the out-of-roundness of the rolls: since in practice it is not possible to obtain rolls which are perfectly circular, this means that, for a fixed position of the bearings supporting the rolls, the separation between the latter varies cyclically as they rotate. It will also be noted that, to the initial out-of-roundness of the rolls, when cold, are added the circularity defects generated by deformations of thermal origin which are due to the cyclic heating and cooling of the surface of the rolls at each revolution.

DESCRIPTION OF THE PRIOR ART

Various control methods are already known which try to provide a solution to one or more of the problems mentioned above.

Thus, a casting process is known, for example from EP-A-138,059 and EP-A-0,194,628, in which, in order to prevent damage to the casting rolls in the event of oversolidification of the cast metal, the separation of the rolls is varied as a function of the separation force exerted on them by the cast product, this force being assumed to be representative of the state of solidification of the metal. However, this method leads, as was seen previously, to longitudinal variations in thickness of the strip obtained.

A method is also known, from the aforementioned documents, in which the speed of the rolls (and therefore the rate of casting) is varied as a function of the variations in separation or in force. This method, based on the fact that, if the speed increases, the solidification time for the molten metal in contact with the rolls is reduced, and therefore there is less solidification (and conversely), does not, however, make it possible to react sufficiently quickly to avoid the problems of oversolidification or undersolidification which may occur suddenly. Consequently, this method can be used in practice only in combination with the above method for adjusting the separation as a function of the separation force.

A casting process is also known in which the position of the bearings of the rolls is varied in order to take into account the circularity defects of the surface of the rolls, by measuring these circularity defects and by consequently correcting the position of the bearings as a function of the angle of rotation of the rolls. However, this method does not make it possible, as will be easily understood, to solve the problems associated with the state of solidification of the cast metal.

OBJECTS AND SUMMARY OF THE INVENTION

The object of the present invention is to solve jointly the problems mentioned hereinabove and its aim is particularly go make it possible:

- to cast without any risk of rupture of the strip or of breakouts;
- to prevent the rolls from being damaged;
- to prevent what are called "bright spots" on the rolls, which are the sign of high concentrations of separation force and which are reflected in a localized modification of the surface finish (rugosity) of the rolls, prejudicial to the subsequent uniformity of the solidification of the first solidified skin;
- and most especially, to obtain a metal strip with a thickness as constant as possible over its entire length and to obtain this uniform thickness as quickly as possible after the commencement of casting.

With these objectives in mind, the subject of the invention is a control process for twin-roll continuous casting, in which, during casting, the roll separation force is measured and the position of the bearings of at least one of the rolls is varied in order to increase or decrease the centre-to-centre of the said rolls, characterized in that, with a view to keeping the said force substantially constant, a band of force values bracketing a desired nominal force is predefined and the position of the bearings is varied more sharply when the value of the measured force lies outside the said band than when it lies within the said band.

Thus, in accordance with the invention, the magnitude of the deviation between the measured separation force and the desired nominal force is taken into account in order to vary the position of the bearings of the rolls: as long as the force remains within the predetermined band, that is to say that it deviates relatively little from the nominal force value, the response, consisting in moving the bearings of the rolls in order to compensate for this variation in force, will be moderate, or even zero, whereas, if the force goes outside the said band, the response will be sharper.

According to one particular arrangement of the invention, the position of the bearings being regulated to a set position, the set position is defined by a reference position value, determined by making a correction, which can vary as a function of the difference between the measured separation force and the nominal force, to an initial set value for the position of the bearings, the correction being greater when the measured force lies outside the band than when it lies within the band.

Preferably, the magnitude of the corrective action is modulated, in response to a deviation between the set value of the separation force and its measured actual value, by making a correction to the signal E representing this deviation, this correction, defined by a function being such that it reduces the strength of this signal when the measured force lies within the predefined band, and it is the signal $E'=f(E)$ thus corrected which is then used in the control loop in order to generate the correction $\Delta d$ which is added to the initial set value $d_0$ for the position of the bearings in order to form the reference position value $d_r$, used in turn as the set point in a conventional control loop for controlling the position of the bearings.

The rate of movement of the bearings is classically, in such a control loop, in proportion to the deviation between the actual position of the bearings and the set position. It follows that the further away from the value of the actual position measurement the reference position value is, the more rapid the action upon the position of the bearings is.

Moreover, since the effect of the correction is to move the set position beyond the initial set position, and in the direction leading to an increase in the deviation between set position and actual position of the bearings, this being the more so the further away from the nominal force the measured force is, it follows that the responsiveness of the control of the position of the bearings is increased when the measured force goes outside the band.

In other words, the correction leads to the generation of an artificial reference position value which defines a set position which is shifted, with respect to the initial set position, in the direction leading conventionally to compensating for a variation in the separation force, that is to say in the direction of moving the rolls apart in response to an increase in the said separation force, and vice versa. Moreover, since this reference position value, used as a set point for the control of the position of the bearings, then lies far from the value of the measurement of the actual position of the bearings, this control will respond more sharply in order to move the bearings than if the set position had remained the initial set position.

According to one particular embodiment, the corrected signal E' increases as a function of the difference between the measured separation force and the nominal force. In this case, the greater the deviation between the measured force and the nominal force the sharper will be the response. Preferably, therefore, the corrected signal E' increases more rapidly when the measured force lies outside the band than when it lies within the band. It then follows that not only does the responsiveness increase with the deviation between measured force and nominal force, but it increases all the more rapidly the greater the deviation is.

According to another embodiment, the corrected signal is zero when the value of the measured force lies within the band and increases as a function of the difference between the measured separation force and the nominal force when the value of the measured force lies outside the band. In this case, as long as the measured force remains within the band, the control of the position of the bearings acts normally in order to keep them in the initial set position, this amounting to tolerating the force variations without seeking to compensate for them by moving the bearings, as long as they remain within the band. In contrast, as soon as the measured force goes outside this band, the position of the bearings will be varied all the more sharply the further the measured force moves away from the band limits.

According to another particular arrangement, the correction is reduced after a predetermined start-up period. Thus, added to the modulation, explained hereinabove, of the magnitude of the corrective action depending on the measured force, is an additional modulation depending on the casting phase. This modulation enables the responsiveness of the control during the start-up period to be further increased, so as to achieve a steady state as rapidly as possible, and to enable this responsiveness to be reduced once this substantially steady state has been achieved, so as to prevent a force peak of very short duration, occurring after the start-up period, from then leading to a substantial variation in the separation of the rolls, as would be the case during the said start-up period. It should be noted that this second modulation applies independently, whether the measured force lies within the band or without it.

In a similar way, and with a substantially equivalent effect, the force band may be relatively narrow during the start-up period, and be widened subsequently.

The above last two arrangements have the purpose:

of ensuring very high responsiveness of the control during the start-up phase, in order to compensate as much as possible for the abrupt variations in the casting parameters which occur as the plant is settling down to a steady state and which are due to the speed-up of the rolls, to them coming up to temperature and to them subsequently deforming, thus favouring the continuity aspect of the casting, even if it entails variations in the gap;

and, thereafter, of reducing this responsiveness in order to favour the constancy of the thickness of the cast product, by tolerating more readily possible force peaks without (or only slightly) varying the position of the bearings.

BRIEF DESCRIPTION OF THE DRAWINGS

Other characteristics and advantages will appear in the description which will be given by way of example of a process for the twin-roll continuous casting of thin steel strip.

Reference will be made to the appended drawings in which:

FIG. 1 is a diagrammatic front view of a twin-roll casting device of type known per se;

FIG. 2 is a diagram of the control loop used in accordance with the invention to control the roll separation force;

DETAILED DESCRIPTION OF THE PREFERRED EMBODIMENTS

Figure 3:
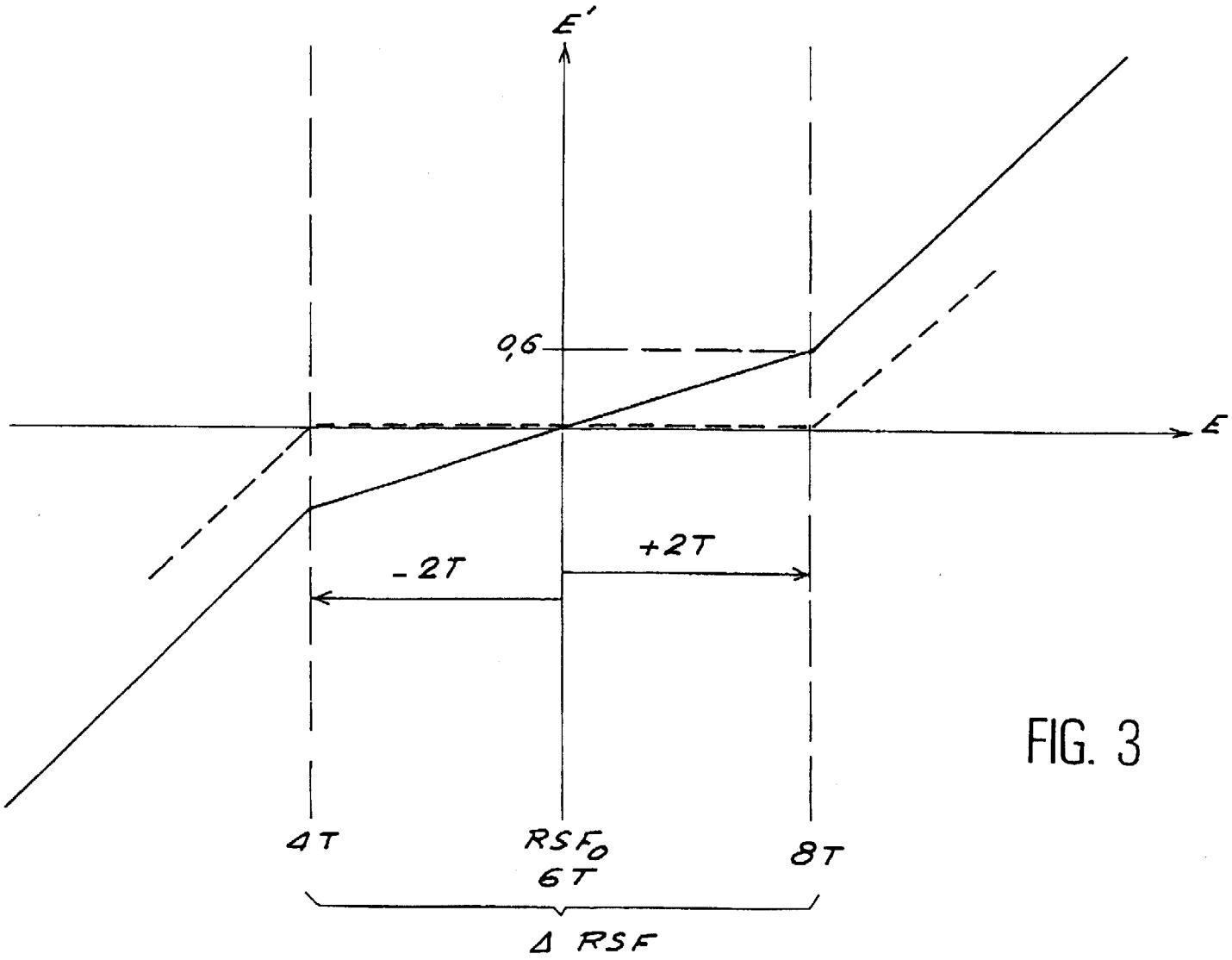
FIG. 3 is a representation of the correction curve for the measured separation force, used in the control loop of FIG. 2.

The casting plant, shown only partially in FIG. 1, conventionally includes, as is known per se, two rolls 1, 2 which have parallel axes and are spaced apart from each other by a distance corresponding to the desired thickness of the cast strip. The two rolls 1, 2 are driven in counter-rotation at the same speed. They are carried by bearings 3, 4, shown diagrammatically, which are in turn bourne of two supports 5, 6 which are mounted on a frame 7. The support 5, and therefore the axis of the corresponding roll 1, is fixed with respect to the frame 7. The other support 6 is movable translationally on the frame 7. Its position is adjustable and determined by thrust cylinders 9 acting so as to move the supports closer together or further apart. Means for measuring the roll separation force, such as load cells 8, are arranged between the fixed support 5 and the frame 7. Sensors 10 make it possible to measure the position of the movable support 6, and therefore the variations in position with respect to a predetermined set position depending on the desired thickness of the strip.

During a casting run, the molten metal is poured between the rolls and starts to solidify on contact with their cooled walls, forming solidified skins which are entrained by the rotation of the rolls and join up substantially in the region of the neck 11 between the rolls in order to form the solidified strip, which is extracted downward. In this situation, the metal exerts a separation force RSF, measured by the load cells 8, on the rolls, this force varying, especially depending on the degree of solidification of the metal.

In order to control this force, and to guarantee continuity of casting, the thrust cylinders 9 are acted upon. Thus, for example, to reduce the separation force RSF, the cylinders 9 are acted on in the direction leading to moving the rolls apart and, conversely, to increase the force, the cylinders are acted upon in the direction of moving the rolls closer.

This action is carried out automatically by a control which, according to the invention, makes it possible to obtain a substantially constant separation force, very rapidly after the commencement of casting, and a thickness of the strip obtained which is also substantially constant.

FIG. 2 illustrates a block diagram for the control loop controlling the roll separation force. In this control loop, the difference E between the value of the separation force RSF, measured by the load cells 8, and the force set value $RSF_0$ is computed by the computation unit 20. This deviation E is entered into a correction device 22 which determines a corrected value E', which is a function of E, according to a relationship which will be described in more detail later. The value E' is introduced into a variable-gain amplifier 24 which converts E' into a speed v, proportional to E, which is itself integrated in the integrator 26 in order to provide a correction Δd.

The correction Δd is introduced into an adder 28 which also receives an initial position set value $d_0$ and an out-of-roundness compensation value $C_{fr}$, and formulates a position reference value $d_r$.

The position reference value $d_r$, which serves as the set point in the control of the position of the bearings, is introduced into a comparator 30 which also receives the measured value $d_m$ of the position of the bearings, this being measured by the sensors 10, and produces a signal $E_p$ representing the deviation between the actual position of the bearings and the set position. This signal is introduced into a conventional (PID) control loop 32 which provides a signal $i_{sv}$ to a servo-valve 34 for controlling the thrust cylinders 9. Acting on the thrust cylinders has an effect on the execution of the casting process (symbolized by the "process" box 36) during which the value of the separation force RSF is measured.

It will be noted that the cycle time of the control loop for controlling the position of the thrust cylinders 9 (this loop is shown diagrammatically by the dotted frame 36) is, for example, $2\times10^{-3}$ seconds, whereas the overall cycle time (dotted frame 38) is, for example, $10\times10^{-3}$ seconds.

The correction f made by the correction device 22 is shown graphically in FIG. 3, in which are indicated, solely by way of example, numerical values of E and E', expressed in tons, In this example, the nominal value $RSF_0$ of the separation force is 6 t (6 tons being approximately 6,000 daN) and the band of forces ΔRSF is 4 t. As long as the measured value of the separation force lies between 4 and 8 t, the correction of the deviation E is expressed by E'=0.3 E; when the separation force falls below 4 t or above 8 t, the correction becomes E'=E−1.4 t.

It may be seen that, according to this example, and by referring to the diagram in FIG. 2, the correction Δd generated from the value E' increases continuously as a function of the difference between the measured separation force RSF and the nominal force $RSF_0$, but, moreover, it increases more strongly as soon as the separation force goes outside the band ΔRSF. As a consequence, the responsiveness of the control of the position of the bearings is, as it were, lessened as long as the measured separation force remains within the said band, and increased outside it.

It will be noted that the expressions for E', indicated hereinabove, are to be considered in a relative manner, because of the fact that the value E' is subsequently multiplied by the gain of the amplifier 24, and integrated over one cycle time, in order to give the correction Δd.

Moreover, it will be noted that an equivalent effect as regards the computation of Δd could be achieved by entering the difference E directly into the amplifier 24 and by varying the gain of the latter as a function of E, that is to say by increasing the gain when the separation force is outside the band, compared to the gain when the said force is within the band.

However, as will be seen subsequently, the gain may also be adjusted as a function of the time elapsed after the start-up of casting. It would therefore follow that the gain would need to be adjusted as a function of two parameters, time and separation force, which may in practice complicate the implementation of the control.

The variation in E' as a function of E could also be defined differently, for example E' being zero or substantially zero as long as the separation force lies within the band and increasing as a function of E outside this band, as shown by the dotted line in FIG. 3.

In the latter case, the reference position $d_r$ would therefore only be corrected if the separation force were to go outside the band, and any force variation remaining within the band would lead to no movement of the bearings of the rolls.

Preferably, the correction made to the reference position of the bearings is reduced after a predetermined start-up period, which may be easily achieved by decreasing the gain and therefore the value $\Delta d$.

Complementarily, the width of the band may be increased. These two measures allow very great responsiveness of the control during the start-up of casting, but do not result in substantial movement of the bearings of the rolls when force peaks occur after the said start-up period.

Figure 4:
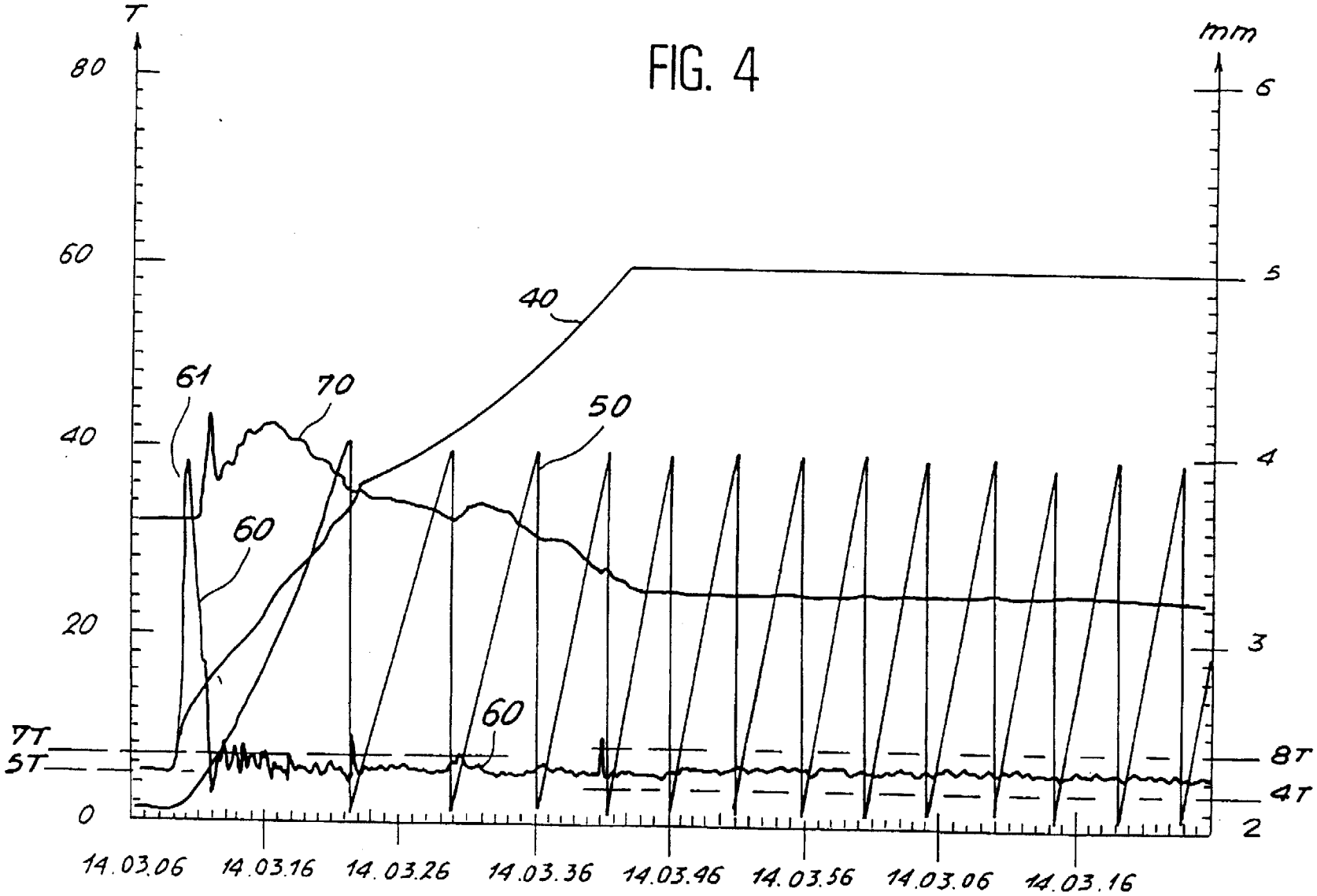
FIGS. 4 and 5 are graphical representations showing the change as a function of time, at the commencement of casting, in the rate of extraction, in the angle of rotation of a point on the surface of one roll, in the position of the bearings of the movable roll and in the roll separation force exerted by the cast product.

In order to illustrate the results obtained by virtue of the invention, FIG. 4 shows the change as a function of time, from the start-up of casting, in four parameters:

trace 40 represents the speed of the rolls;

trace 50 represents the angular position of one roll, the gap between two peaks of this curve corresponding to one revolution of the roll;

trace 60 represents the variations in the separation force (RSF), measured in tons (graduated scale on the left of the graph);

trace 70 represents the variations in the position of the bearings, these variations being measured in mm (graduated scale on the right).

These traces correspond to a casting run carried out in accordance with the process according to the invention, by fixing the nominal force at 6 tonnes and a band spread $\Delta RSF$ of 2 tonnes for approximately 35 seconds, and subsequently widened to 4 tonnes.

It may be observed that, after a large force peak 61 at start-up, the force still varies substantially during the first revolutions of the rolls, with a few excursions outside the 5–7 ton band. Correspondingly, trace 70 shows, during this same period, the large variations corresponding to the movements of the bearings of the movable roll in order to compensate for the force variations. However, it may be observed that, after the first revolution of the rolls, the separation force remains within the band.

When the band is widened to 4–8 t, after the start-up period, the force variations remain small and, in addition, the bearings of the rolls virtually no longer move, this being explained by the fact that the separation force is maintained in the centre of the band and that its variations, lessened by the correction indicated above, have virtually no effect on the control of the position of the bearings.

It may therefore be stated that the implementation of the process according to the invention makes it possible rapidly to achieve, and thereafter to maintain, a separation force and a roll axis separation which are substantially constant.

Figure 5:
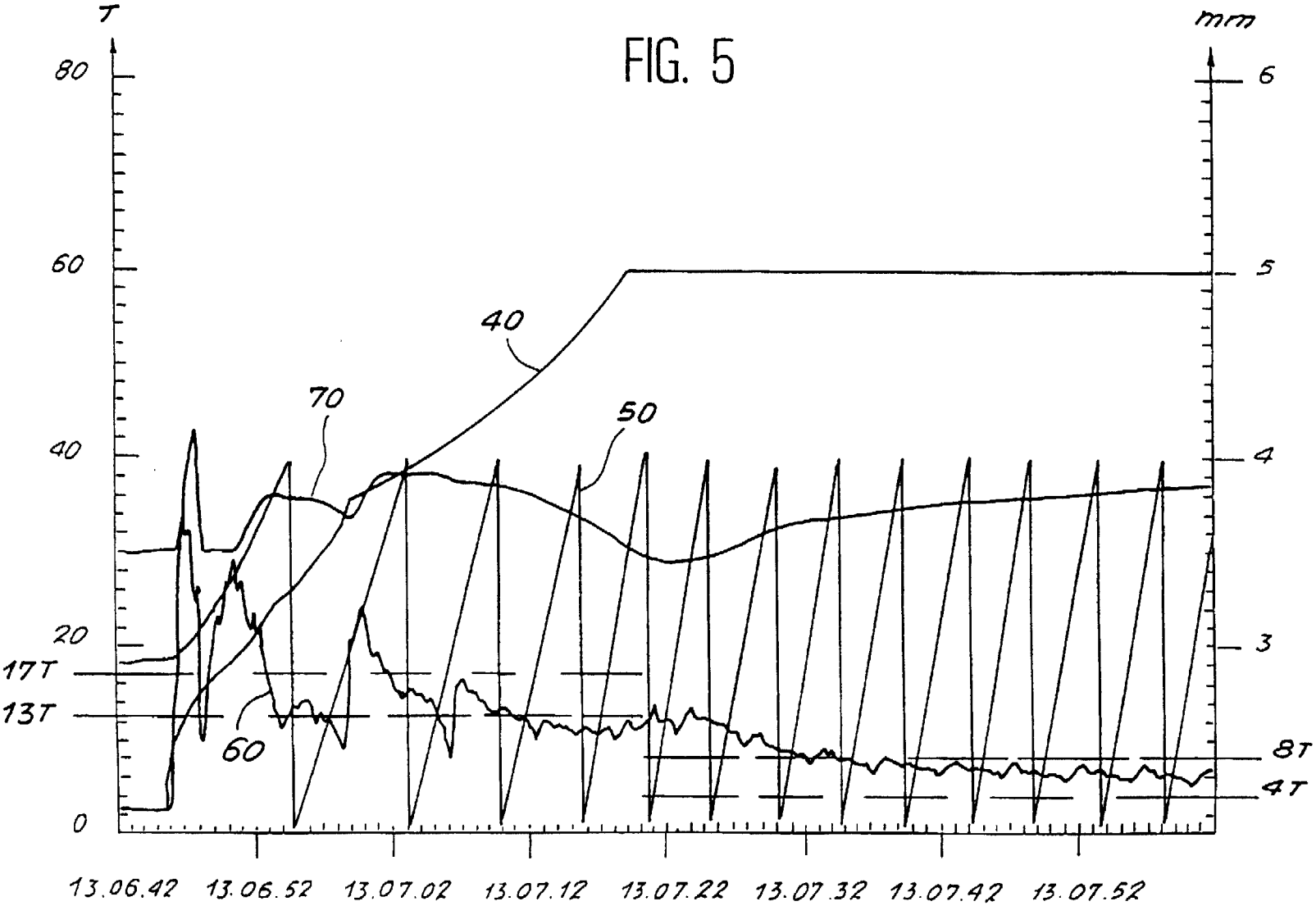

The corresponding recordings shown in FIG. 5, for the case where the nominal force has been fixed at the start at 15 tons with a band width of 4 tonnes, indicate that the separation force becomes stable, as does the position of the bearings, but in this case it requires a longer time to achieve this stabilization, which demonstrates the advantage of fixing, at start-up, as small as possible a nominal force value with a band width which is also small, as is the case in FIG. 4.

It will be noted that, in addition to the control described hereinabove, the process according to the invention integrates an out-of-roundness control in order to take into account the roll circularity defects and to compensate for them so as not to have cyclic variations in the thickness of the cast strip.

To do this, the roll circularity deviations are determined by measuring the variations in the separation force as a function of the angle of rotation of the rolls, this measurement being made during the first revolutions of the rolls at the start-up of casting, and, thereafter, the reference value for the position of the bearings is modified as a function of the angle of rotation in order to compensate for the circularity deviations.

The circularity deviations may be determined by a computer which extracts, from the curve of the variations in the measured separation force, the cyclic variations which signify that there are circularity defects, and a correction $C_{fr}$ is formulated which is applied to the initial set value $d_0$ and to the correction $\Delta d$ in order to form the position reference value $d_r$.

Figure 6:
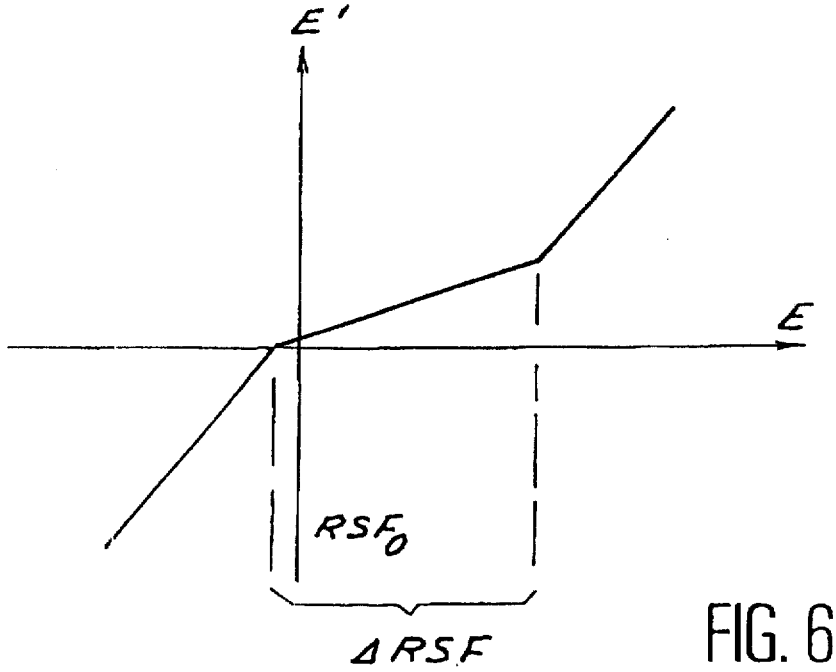
FIGS. 6 and 7 illustrate two alternative forms of the force correction E'=f(E).
Figure 7:
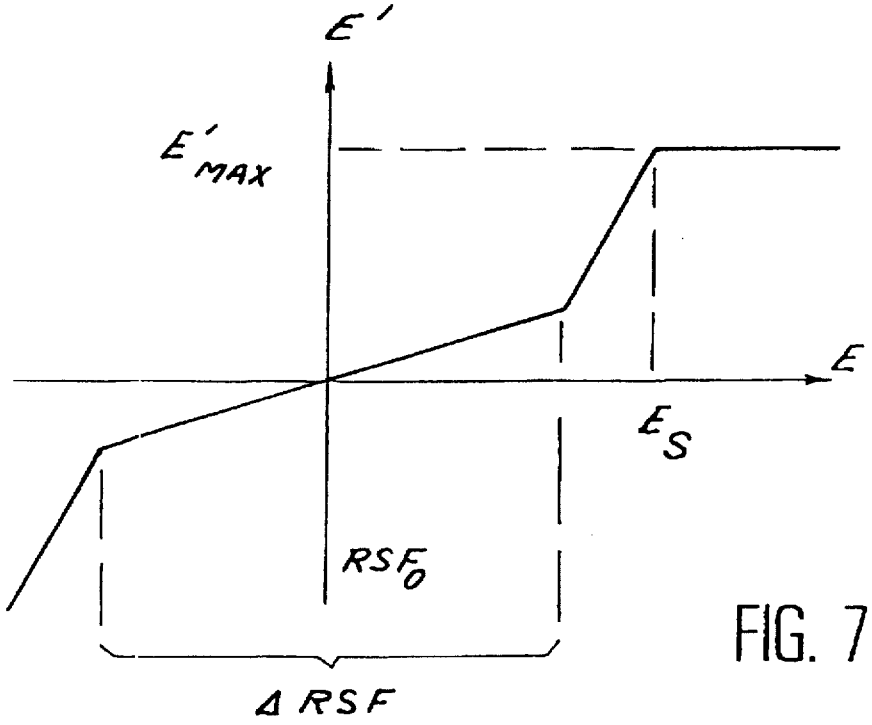

The drawings in FIGS. 6 and 7 show two alternative forms of the correction f which may be used by the correction device 22.

In the alternative form shown in FIG. 6, the band $\Delta RSF$ is no longer centered on the nominal value $RSF_0$, as in the case of FIG. 3, but offset to the right, that is to say in the direction of increasing force. Using such a correction, the responsiveness of the control of the position of the bearings is lessened, as indicated above, only when the measured separation force RSF is greater than the set value $RSF_0$. In contrast, if the measured force is less than the set value, the control acts normally, that is to say more sharply, which action prevents too abrupt a decrease in the force and therefore prevents an excessively low force value being reached. This is particularly useful when the set value $RSF_0$ is itself low, for example of the order of 2 tonnes.

In the alternative form shown in FIG. 7, the correction applied when the separation force remains close to the set value is similar to that shown in FIG. 3, that is to say one which lessens the responsiveness of the control as long as the measured force RSF remains within the predetermined band $\Delta RSF$. In contrast, a maximum value $E'_{max}$ is imposed on the corrected value E' when the measured force exceeds a certain threshold (defined by $E_s$ in FIG. 7). Thus, while still maintaining high responsiveness of the control when the measured force goes outside the band $\Delta RSF$, an excessive roll separation in response to a very high, but very short, force peak is avoided, and therefore the rolls return more rapidly to their normal position as soon as the force peak has passed.

Of course, these last two alternative forms of correction could be combined.

We claim:

1. A process for maintaining a substantially constant roll separation force for a continuous casting operation in which a product is cast between two spaced rolls, each of which is rotatably supported on a set of roll bearings, comprising:

providing a predetermined roll separation force band bracketing a desired nominal roll separation force;

measuring a value of the roll separation force as a function of the spacing between the rolls; and altering a position of at least one set of roll bearings to vary a center-to-center spacing of the rolls so as to attempt to cause an actual roll separation force to equal the desired nominal roll separation force, wherein the position of the set of roll bearings is altered by a higher rate if the value of the measured separation force lies outside the force band than if the value of the measured separation force lies within the force band.

2. A process as defined in claim 1, wherein the altering step comprises altering a value of a reference position to which the set of roll bearings is set and then altering the position of the set of roll bearings to place the set of roll bearings at the altered reference position, wherein the value of the reference position is altered by applying a correction value to an initial value of the reference position, and wherein the correction value is varied as a function of the difference between the measured separation force and the desired nominal roll separation force and is greater when the value of the measured separation force lies outside the force band than when the value of the measured separation force lies within the force band.

3. A process according to claim 2, further comprising obtaining a corrected signal by making a correction defined as a function of the difference between the measured separation force and the desired roll separation force, and computing the correction value on the basis of the corrected signal.

4. A process according to claim 3, wherein the corrected signal increases as a function of the difference between the measured separation force and the desired nominal roll separation force.

5. Process according to claim 3, wherein the corrected signal is zero when the value of the measured force lies within said band and increases as a function of the difference between the measured force and the nominal force when the value of the measured force lies outside said band.

6. A process according to claim 4, wherein the corrected signal increases more rapidly when the value of the measured separation force lies outside the force band than when the value of the measured separation force lies within the force band.

7. Process according to claim 3, wherein said band is shifted with respect to the nominal force in the direction of increasing force.

8. Process according to claim 6, wherein a maximum value is assigned to the corrected value when the value of the measured force exceeds a predefined threshold.

9. A process according to claim 2, wherein the correction value is reduced after a predetermined start-up period.

10. A process according to claim 2, wherein the value of the force band is widened after a predetermined start-up period.

11. A process according to claim 2, further comprising determining circularity deviations of the rolls by measuring variations in the separation force as a function of an angle of rotation of the rolls during start-up of the casting operation, and modifying the value of the reference position as a function of the angle of rotation to compensate for the determined circularity deviations.

12. A process comprising:

continuously casting a thin-steel strip between two spaced rolls, each of which is rotatably supported on a set of roll bearings; and maintaining a substantially constant roll separation force between the rolls, the maintaining step including providing a predetermined roll separation force band bracketing a desired nominal roll separation force, measuring a value of the roll separation force as a function of the spacing between the rolls, and altering a position of at least one set of roll bearings to vary a center-to-center spacing of the rolls so as to attempt to cause an actual roll separation force to equal the desired nominal roll separation force, wherein the position of the set of roll bearings is altered by a higher rate if the value of the measured separation force lies outside the force band than if the value of the measured separation force lies within the force band.

* * * * *